US005606886A

United States Patent [19]

Polen

[11] Patent Number: 5,606,886

[45] Date of Patent: Mar. 4, 1997

[54] JAW ASSEMBLY FOR STRETCH FORMER

[76] Inventor: Larry A. Polen, 625 Raintree Dr., Matthews, N.C. 28105

[21] Appl. No.: 374,138

[22] Filed: Jan. 18, 1995

[51] Int. Cl.[6] ..... B21D 11/02

[52] U.S. Cl. ..... 72/296

[58] Field of Search ..... 72/295–297, 311, 72/293, 302, 301

[56] References Cited

U.S. PATENT DOCUMENTS

| | | | |
|---|---|---|---|
| 2,830,644 | 4/1958 | Walker et al. | 153/32 |
| 2,961,028 | 11/1960 | Bath | 153/35 |
| 3,073,373 | 1/1963 | Wheeler et al. | 153/48 |
| 3,250,107 | 5/1966 | Dolney | 72/297 |
| 3,314,270 | 4/1967 | Dolney | 72/305 |
| 3,416,350 | 12/1968 | Eagleson et al. | 72/293 |
| 4,453,394 | 6/1984 | Just | 72/311 |
| 4,492,105 | 1/1985 | Kutz | 72/302 |

FOREIGN PATENT DOCUMENTS

| | | | |
|---|---|---|---|
| 527231 | 9/1976 | U.S.S.R. | 72/311 |
| 858982 | 8/1981 | U.S.S.R. | 72/302 |

*Primary Examiner*—Daniel C. Crane
*Attorney, Agent, or Firm*—W. Thad Adams, III, P.A.

[57] ABSTRACT

A jaw assembly for a stretch former, including a jaw body, an annular nose piece carried by the jaw body and defining an insert chamber, and a tapered-wall insert sleeve for being locked into the insert chamber of the nose piece. The insert sleeve defines an internal bore having tapered walls. An insert is positioned in the bore of the insert sleeve. The insert has a plurality of segments collectively defining a profile corresponding to the profile of a workpiece to be stretch-formed, the insert having a tapered outer wall for sliding, interference fit engagement with the tapered walls of the insert sleeve for locking the insert into the jaw and clamping the workpiece into the insert. Pistons are connected to the insert, and the pistons are adapted to move the insert axially within the nose piece among a clamping position wherein the insert clamps the workpiece into the jaw during the stretch forming process, a workpiece remove position retracted from the clamping position for removing the stretch-formed workpiece from the insert and positioning another workpiece into the insert, and an insert remove position retracted from the workpiece remove position at which the insert sleeve and insert may be removed and replaced.

7 Claims, 4 Drawing Sheets

JAW ASSEMBLY FOR STRETCH FORMER

TECHNICAL FIELD AND BACKGROUND OF THE INVENTION

This invention relates to a jaw assembly for a stretch former, such as a stretch-wrap machine. Stretch-wrap forming is a process of forming contoured metal parts, or workpieces, by pulling and wrapping extrusions or formed workpieces around a die. Other actions may be performed on the workpiece at the same time. Stretch-wrap machines tightly clamp the opposing ends of the workpiece in powerful jaws while pivotally-mounted tension cylinders on which the jaws are mounted wrap the workpiece around the curved surface of the die in a combined stretching and bending action.

During the stretch-forming process, the stress on the workpiece in the region nearest the convex side becomes so great that the metal reaches a state of semi-plasticity. This occurs by stretching the workpiece beyond its yield point. Metal structures undergoing such deformation, upon release of the tension on it, will remain permanently deformed. This permanent deformation of the metal causes the workpiece to remain in its desired shape into which it was formed during the stretch-wrap process.

The workpiece is held in the jaws by means of inserts. There are usually several insert segments which collectively make up the insert. These insert segments fit together and define at their adjoining, axially-extending surfaces a profile which corresponds to the profile, i.e., the cross-section, of the workpiece to be formed. The insert segments are placed within an insert chamber in the nose piece of the jaw. They are retained in the jaw, without attachment to each other, by a retaining ring of reduced diameter fitted to the face of the nose piece. The insert is mounted for sliding movement to a tapered insert sleeve. The taper on the insert sleeve is oriented so that the pull of the opposite tension cylinder wedges the insert ever more tightly against the insert sleeve, creating intense clamping pressures on the ends of the workpiece. When the opposed tension cylinders release tension on the workpiece, the pressure is likewise reduced on the workpiece by the jaws. The insert is then retracted by a hydraulic cylinder assembly to loosen the insert segments, so that the workpiece can be removed and a new workpiece inserted.

Whenever a workpiece having different profiles is to be formed, the insert must be changed. In prior art devices, this requires that the nose piece be partially disassembled, and the insert segments manipulated to avoid interference from the insert actuator to which the insert is mounted as they are removed. The insert actuator has an enlarged shoulder around which the insert segments fit. In order to remove the insert segments, the segments are retracted so that the taper loosens the insert segments. In prior art jaws, this distance is insufficient to permit removal of the insert segments without carefully manoeuvering the segments away from the insert actuator.

This is a difficult task, since the area inside the nose piece is quite confined, and the insert segments are very heavy and difficult to handle. Injury can occur, since the hands of the operator must be inserted into the nose piece. Placement of the new insert segments is likewise difficult, since the segments must be carefully fitted into the nose piece and into locking contact with the insert actuator.

This invention increases the ease with which the insert segments which make up the insert can be removed and replaced by providing for retraction of the insert actuator well beyond the workpiece remove position.

SUMMARY OF THE INVENTION

Therefore, it is an object of the invention to provide a jaw assembly for a stretch-forming machine which permits easy removal and replacement of inserts.

It is another object of the invention to provide a jaw assembly which has a hydraulic system which permits withdrawal of the insert actuator sufficiently to permit removal of the insert without interference from the insert actuator.

It is another object of the invention to provide a jaw assembly which includes a secondary piston which cooperates with the primary cylinder of the jaw to control the position of the primary cylinder between workpiece remove and insert remove positions.

It is an object of the invention to provide a stretch former which has a jaw assembly for a stretch-forming machine which permits easy removal and replacement of inserts.

It is another object of the invention to provide a stretch former which has a jaw assembly which has a hydraulic system which permits withdrawal of the insert actuator sufficiently to permit removal of the insert without interference from the insert actuator.

It is another object of the invention to provide a stretch former which has a jaw assembly which includes a secondary piston which cooperates with the primary cylinder of the jaw to control the position of the primary cylinder between workpiece remove and insert remove positions.

These and other objects of the present invention are achieved in the preferred embodiments disclosed below by providing a jaw assembly for a stretch former, comprising a jaw body, an annular nose piece carried by the jaw body and defining an insert chamber, and a tapered-wall insert sleeve for being locked into the insert chamber of the nose piece. The insert sleeve defines an internal bore having tapered walls. An insert is positioned in the bore of the insert sleeve. The insert has a plurality of insert segments collectively defining therebetween a profile corresponding to the profile of a workpiece to be stretch-formed, the insert having a tapered outer wall for sliding, interference fit engagement with the tapered walls of the insert sleeve for locking the insert into the jaw and clamping the workpiece into the insert. Piston means are connected to the insert, and the piston means are adapted to move the insert axially within the nose piece among a clamping position wherein the insert clamps the workpiece into the jaw during the stretch forming process, a workpiece remove position retracted from the clamping position for removing the stretch-formed workpiece from the insert and positioning another workpiece into the insert, and an insert remove position retracted from the workpiece remove position at which position the insert sleeve and insert may be removed and replaced.

According to one preferred embodiment of the invention, the piston means comprises an insert actuator connected to the insert, a piston rod connected to the insert actuator, and a primary piston carried by the piston rod in a hydraulic cylinder. The primary piston has a stroke defining at a forward extreme thereof the clamping position and at a rearward extreme thereof the insert remove position, and a workpiece remove position at a position intermediate the clamping position and the insert remove position.

According to another preferred embodiment of the invention, the piston means includes a secondary piston coaxially positioned in the cylinder and hydraulically moveable between first and second positions in the cylinder, the secondary piston defining at the first position the intermediate, workpiece remove position of the primary piston and at the rearward extreme position the insert remove position of the primary piston.

According to yet another preferred embodiment of the invention, the secondary piston is slidably mounted on a retaining bolt for movement between its first and second positions.

Preferably, the cylinder is formed in the jaw body.

According to yet another preferred embodiment of the invention, a stretch former of the type wherein a workpiece to be formed is clamped and stretched over a die by the action of a tension cylinder is provided in combination with a jaw assembly carried on a free end of the tension cylinder and clamping an end of the workpiece. The jaw assembly comprises a jaw body, an annular nose piece carried by the jaw body and defining an insert chamber, and a tapered-wall insert sleeve for being locked into the insert chamber of the nose piece. The insert sleeve defines an internal bore having tapered walls. An insert is provided for being positioned in the bore of the insert sleeve. The insert has a plurality of segments collectively defining therebetween a profile corresponding to the profile of a workpiece to be stretch-formed, the insert having a tapered outer wall for sliding, interference fit engagement with the tapered walls of the insert sleeve for locking the insert into the jaw and clamping the workpiece into the insert. Piston means are connected to the insert, and the piston means is adapted to move the insert axially within the nose piece among a clamping position wherein the insert clamps the workpiece into the jaw during the stretch forming process, a workpiece remove position retracted from the clamping position for removing the stretch-formed workpiece from the insert and positioning another workpiece into the insert, and an insert remove position retracted from the workpiece remove position at which position the insert sleeve and insert may be removed and replaced.

According to one preferred embodiment of the invention, the piston means comprises an insert actuator connected to the insert, a piston rod connected to the insert actuator, and a primary piston carried by the piston rod in a hydraulic cylinder. The primary piston has a stroke defining at a forward extreme thereof the clamping position and at a rearward extreme thereof the insert remove position, and a workpiece remove position at a position intermediate the clamping position and the insert remove position.

According to another preferred embodiment of the invention, the piston means includes a secondary piston coaxially positioned in the cylinder and hydraulically moveable between first and second positions in the cylinder, the secondary piston defining at the first position the intermediate, workpiece remove position of the primary piston and at the rearward extreme position the insert remove position of the primary piston.

According to yet another preferred embodiment of the invention, the secondary piston is slidably mounted on a retaining bolt for movement between its first and second positions.

Preferably, the cylinder is formed in the jaw body.

According to yet another preferred embodiment of the invention, a stretch former is provided of the type wherein a workpiece to be formed is clamped by its opposing ends and stretched over a die by the action of a pair of opposed tension cylinders. The jaw assemblies of the stretch former are as described above.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Description of Jaw

Figure 1:
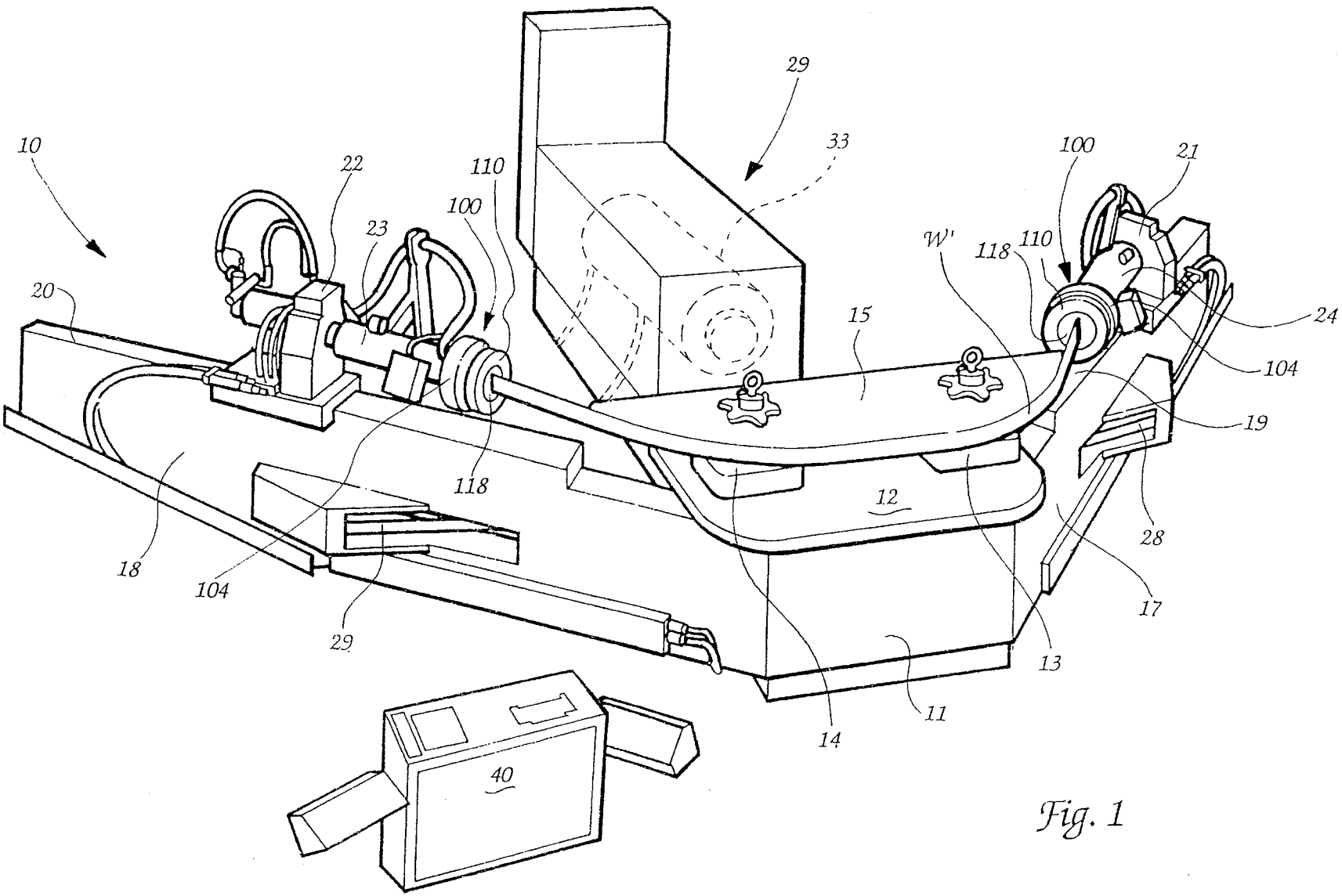
FIG. 1 is a perspective view of a stretch-wrap former according to an embodiment of the invention.

Referring now specifically to the drawings, a stretch-wrap former according to the present invention is illustrated in FIG. 1 and shown generally at reference numeral 10. Machines such as that illustrated in FIG. 1 are known variously as stretch formers, stretch-wrap formers, and stretch-wrap presses. However termed, they perform a variety of functions, but always with a simultaneous stretching and bending of the metal extrusion or formed workpiece. The particular embodiment shown is a stretch-wrapping machine which stretches a workpiece "W" such as an extrusion or angle beam into its yield state and wraps the workpiece around a die to impart a predetermined shape to it. The invention is not limited to any particular type of forming machine, but is applicable to any machine which uses a die around which to form a workpiece.

Stretch former 10 includes a die table 11 which forms a platform for the die table support surface 12, die posts 13 and 14, and die 15 mounted on the die posts 13 and 14. Two wrap arms 17 and 18 are pivotally mounted on opposite sides of the die table 11, and are pivoted rearwardly as the stretch-wrapping process takes place. The wrap arms 17 and 18 have respective ways 19 and 20 on which are mounted moveable carriages 21 and 22. Respective hydraulic tension cylinders 23 and 24 are carried by carriages 21 and 22, and each carries a hydraulically-powered jaw 100 into which the workpiece to be stretch-wrapped is secured by its opposite ends. Jaws 100 are pivoted on the carriages 21 and 22 to permit pivotal movement as the stretch-wrapping process takes place.

A tail section 29 of the die table 11 extends outwardly from the rear of the die table 11 and mounts a pair of wrap cylinders 28 and 29 which, when actuated, pivot the wrap arms 17 and 18 rearwardly, wrapping the workpiece "w" being formed around the die 15. A hydraulic motor 33 supplies pressurized hydraulic fluid to the hydraulic components of the machine 10. A control console 40 permits the operator to monitor and control the operation of stretch former 10.

The die posts 13 and 14 secure the die 15 onto the support surface 12 of the die table 11, prevent rotational movement of the die 15 and provide lateral stability during the wrapping process. The die 15 has a profile which matches the profile of the workpiece to be stretch-wrapped. The profiles mate and provide stability to the workpiece as the stretch-wrapping process continues. Depending on the size of the workpiece, the die 15 will require vertical adjustment. The carriages 21 and 22 include vertical adjustment means for positioning the jaws 100 at the precisely correct vertical position. Ordinarily the jaws 100 will be positioned so that the workpiece is held perpendicularly to the vertical axis, i.e. in a "level" horizontal position.

Figure 2:
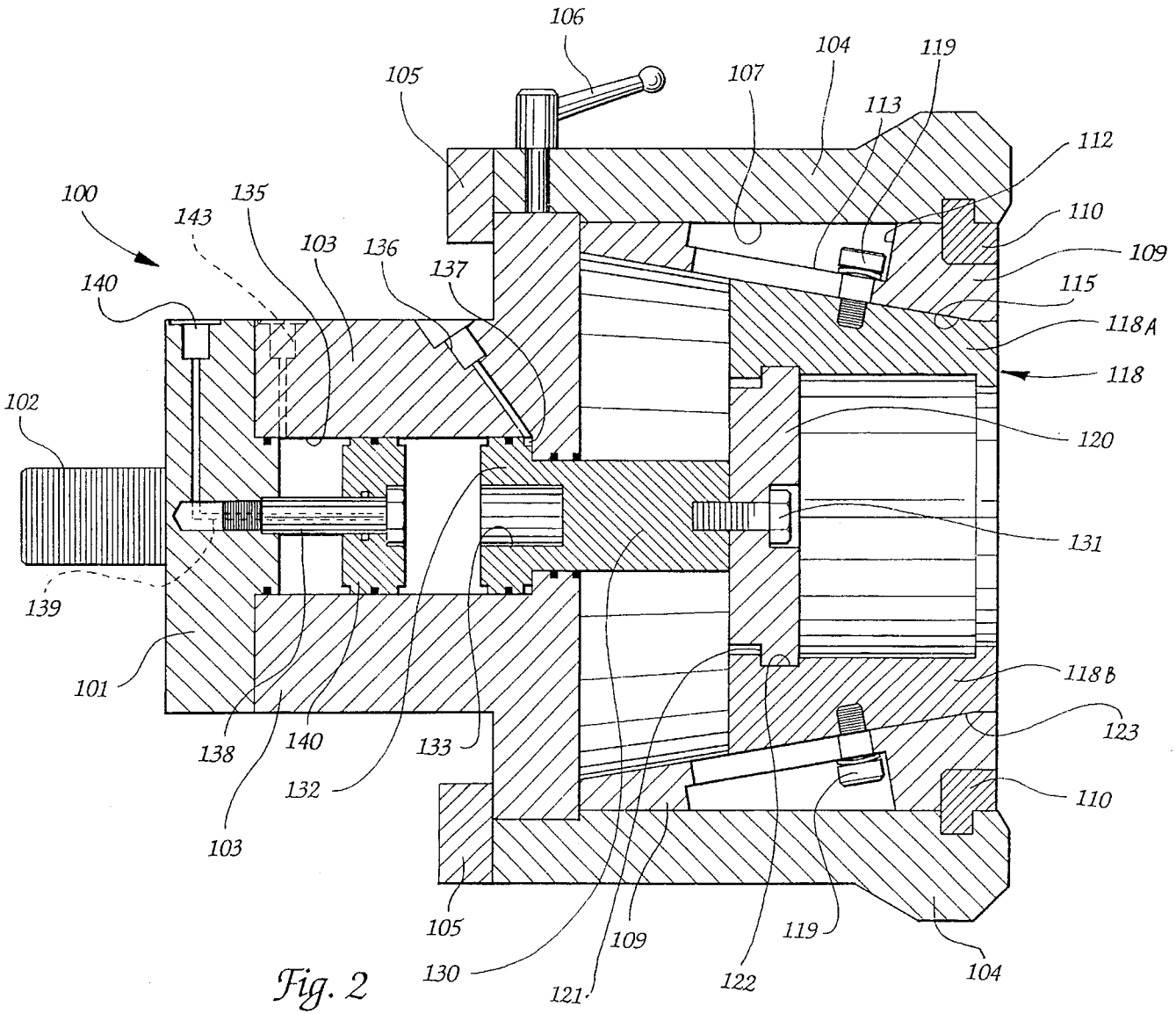
FIG. 2 is a vertical cross-sectional view of one of the jaws shown in FIG. 1 in the clamping position.
Figure 3:
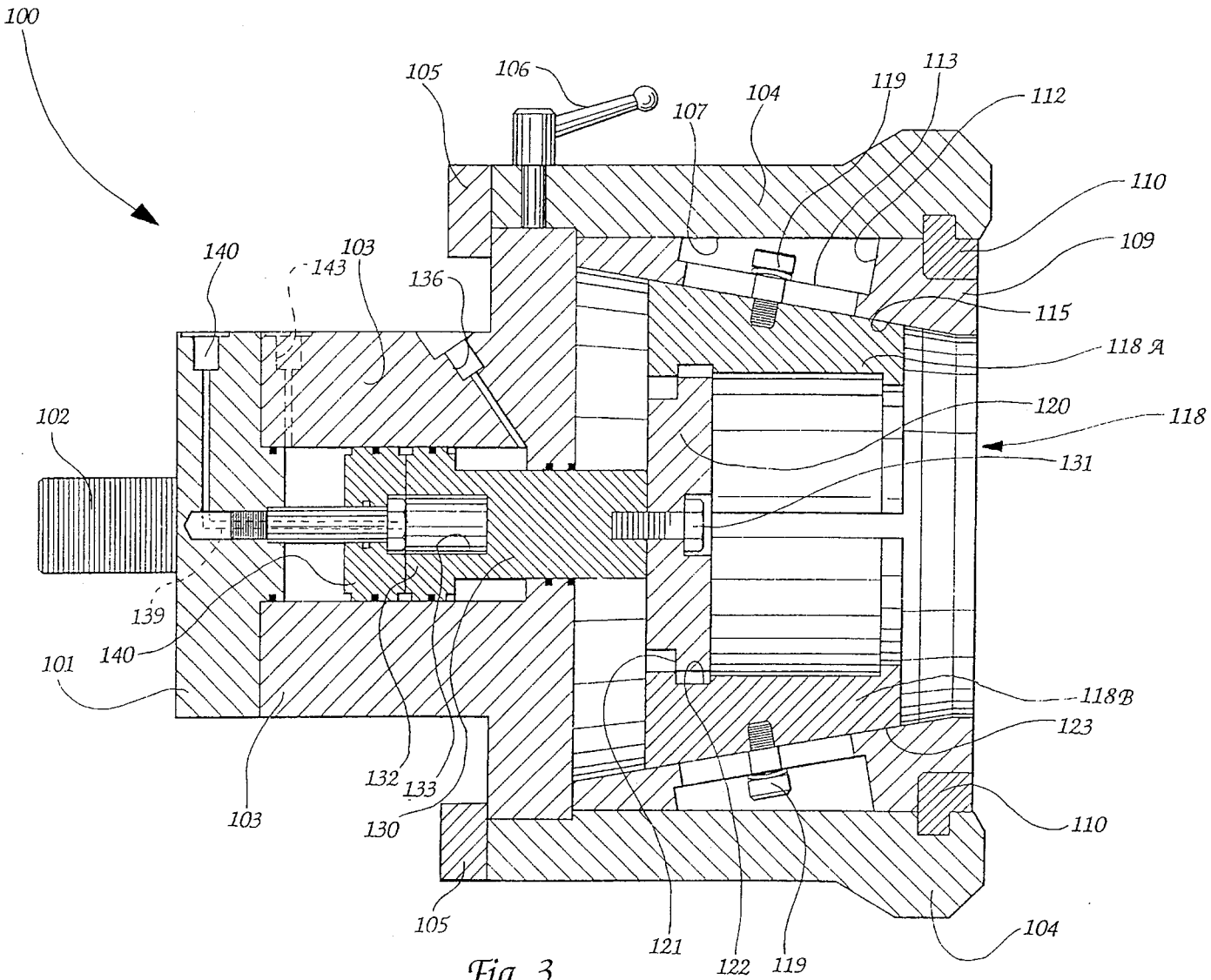
FIG. 3 is a vertical cross-sectional view of one of the jaws shown in FIG. 1 in the workpiece removing position.
Figure 4:
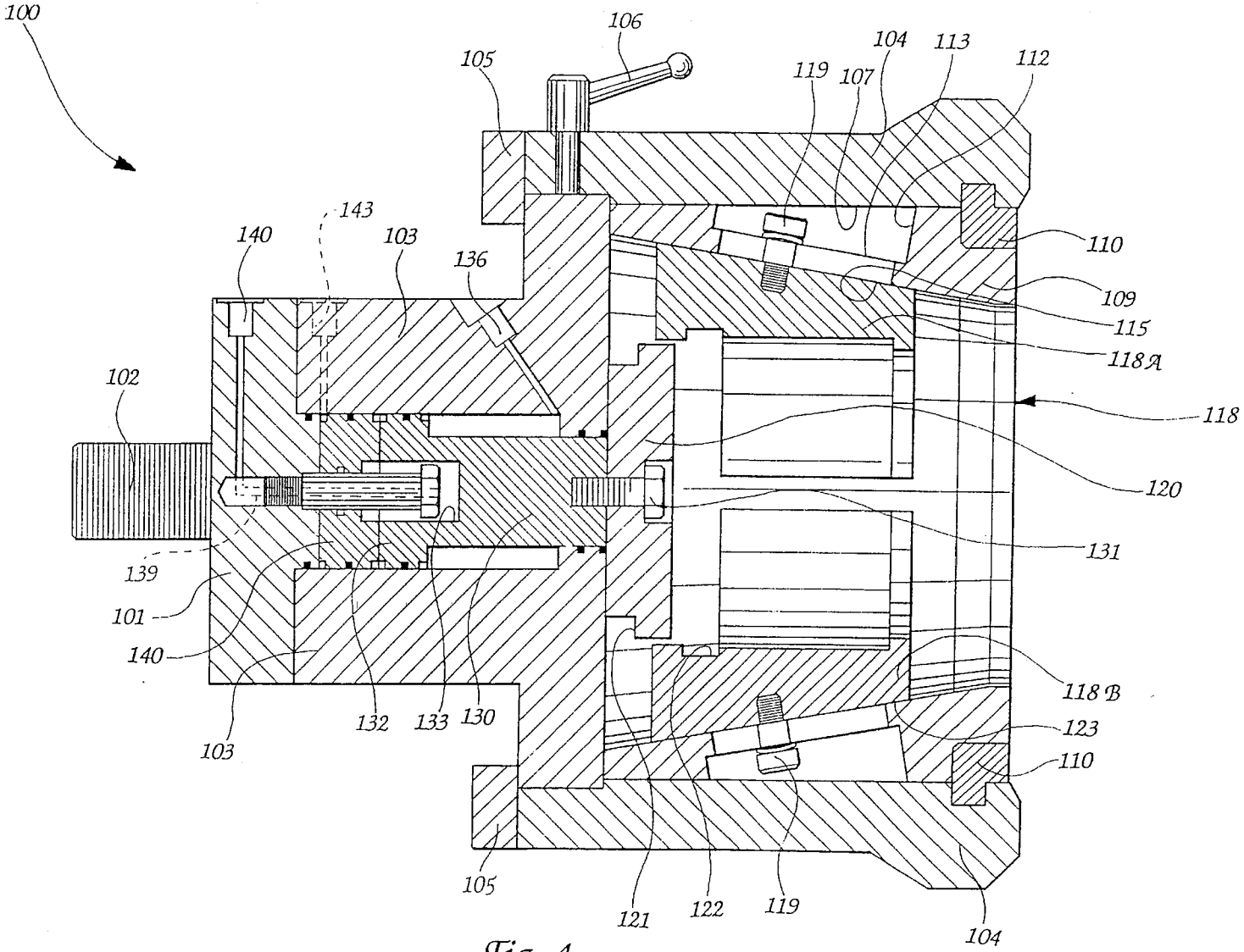
FIG. 4 is a vertical cross-sectional view of one of the jaws shown in FIG. 1 in the insert removing position.

Referring now to FIGS. 2, 3 and 4, the jaws 100 are explained in more detail. Both jaws 100 are identical. Therefore the description proceeds with reference to the jaw 100 which is carried by the carriage 22 mounted on the wrap arm 18. As noted above, the jaw 100 has three distinct positions—a clamping position (FIG. 2); a workpiece remove position (FIG. 3); and a insert remove position (FIG. 4).

Referring now specifically to FIG. 2, jaw 100 includes an adapter plate 101 and a large threaded bolt 102 by which the jaw 100 is attached to the tension cylinder 23. Adaptor plate 101 is bolted to the end of an annular jaw body 103. An annular nose piece 104 is retained on the jaw body 103 by a jaw body retaining ring 105. Retaining ring 105 is bolted to the radial face of the jaw body 103. Nose piece 104 may be rotated for adjustment purposes relative to the jaw body 103 by loosening a handle 106 and manually rotating the nose piece 104.

The nose piece 104 defines an insert chamber 107. A n annular insert sleeve 109 is positioned within the insert chamber 107 and is held in place by an insert sleeve retaining ring 110. Retaining ring 110 cooperates with a bayonet-type mount (not shown) in the mouth of the nose piece 104. The retaining ring 110 is fitted into the mouth of the nose piece 104 and then turned to lock cooperating flanges on the nose piece 104 and the retaining ring 110 into place.

Insert sleeve 109 includes six axially-extending slots 112 (two shown) equally spaced around the periphery of insert sleeve 109. Slots 112 include a shoulder 113 defining the upper extent of an area of reduced width sufficient to receive the shaft portion of a shoulder bolt but not the head. The enlarged head of the shoulder bolt is supported for sliding movement on the shoulder 113. This is further described below. Insert sleeve also 109 includes a inner tapered wall 115 of, for example, 10 degrees. The insert sleeve 109 is relatively thick near the outer end of the nose piece 104 thus defining a relatively small mouth. The tapered wall 115 progressively narrows the thickness of the insert sleeve 109 as the tapered wall 115 extends axially into the nose piece 104.

An insert 118 is positioned in the central portion of the insert chamber 107 not occupied by the insert sleeve 109. Insert 118 is formed of insert segments 118A and 118B, which are loosely fitted into the insert chamber 107. More than two insert segments may be used, depending on the profile of the workpiece being stretch-wrap formed. It is the relative shapes of the insert segments 118A and 118B which define the profile of the insert 118. The profile of the insert 118 matches the profile of the workpiece. For example, if the workpiece has an I-beam shape in cross-section, then the insert segments 118A, 118B mate together to form at their adjoining surfaces an I-beam-shaped space into which one end of the workpiece "W" is placed. Outer walls 123 of insert segments 118A and 118B have the same degree of taper and the mating walls 115 of the insert sleeve.

Shoulder bolts 119 are threaded into the outer walls of the inserts 118A and 118B, and fit in the slots 112 in insert sleeve 109. The heads of the bolts 119 ride on the shoulders 113 of the respective slots 112 and permit controlled sliding movement of the insert segments 118A and 118B relative to the stationary insert sleeve 109.

Insert segments 118A and 118B are mounted on an insert actuator 120. Insert actuator 120 includes an enlarged diameter flange 121 which mates with an annular recess 122 in the inner wall of the insert segments 118A and 118B. Interference between the flange 121 and the insert segments 118A and 118B securely locks the insert segments 118A, 118B onto the insert actuator 120.

The insert actuator 120 is utilized to move the insert segments 118A and 118B axially in the insert chamber 107. A primary piston 130 is attached by one end to the insert actuator by a shoulder bolt 131. The other end of the primary piston 130 is enlarged and defines a piston head 132 which is captured in a cylinder 135 formed in the jaw body 103 and enclosed by the adaptor plate 101. Piston head 132 includes a concentric recessed bore 133. Hydraulic fluid is supplied to the rod side of the piston head 132 through a hydraulic fluid port 136 which communicates with a small annular chamber 137 formed by an annular recess in the piston head 132.

A secondary piston 140 is positioned in cylinder 135 behind the primary piston 130. The secondary piston 140 is mounted for movement in the cylinder 135 on a stationary bolt 138. Stationary bolt 138 includes a hydraulic fluid port 139 extending therethrough and communicating with a hydraulic fluid port 140 in the adaptor 101. Thus, hydraulic fluid is conveyed to the cavity between the primary piston 130 and the secondary piston 140. Hydraulic fluid is conveyed to the cavity between the secondary piston 140 and the adaptor through a hydraulic fluid port 143.

As is shown, seals along the length of the cylinder 135 maintain pressure and prevent leaks from the cylinder 135.

Description of Operation of Jaw

The construction of the jaw 100 is described above. FIG. 2 illustrates the position of the jaw 100 during the stretch-wrap process. The insert segments 118A and 118B are forward in the insert chamber 107. A workpiece (not shown in FIG. 2, but see "W" FIG. 1) is held-in the jaw 100 by the insert segments 118A and 118B. As in shown in FIG. 1, the tension cylinders 23 and 24 exert opposing tension on the workpiece. The tension on the workpiece causes the insert segments 118A and 118B to pulled forward in the insert chamber 107. The tapered walls 123 of the insert segments 118A and 118B are wedged forward by the tension on the workpiece. This axial wedging causes clamping pressure in the radial direction to be applied to the insert segments 118A and 118B and to the workpiece held in the insert segments 118A and 118B. In this position, the primary piston 130 is forward against the end of the cylinder 135 nearest the insert actuator 120.

Referring now to FIG. 3, when a single forming operation is completed, the tension on the tension cylinders 23 and 24 is released. Hydraulic fluid is introduced through the fluid port 136, forcing primary piston 130 rearwardly towards secondary piston 140. The oppositely-directed pressure of the secondary piston 140 arrests the rearward movement of the primary piston 130, as shown in FIG. 3. This rearward movement of primary piston 130 releases the wedging effect of the insert segments 118A and 118B against the insert sleeve 109 and permits expansion of the insert segments 118A and 118B away from each other, releasing the clamping pressure on the workpiece. After a new workpiece is fitted into the insert segments 118A and 118B, primary piston 130 is pulled forward along with the insert actuator 120 as tension from the tension cylinders 23 and 24 pulls the insert segments 118A and 118B forward, wedging them against the tapered walls 115 of the insert sleeve 109 and again clamping the workpiece securely into the insert segments 118A and 118B.

Referring now to FIG. 4, when it is necessary to remove the insert segments 118A and 118B for repair or replacement, hydraulic fluid is introduced through fluid port 136, and fluid pressure is released the opposite side of the secondary piston 140 by permitting fluid to exit through the fluid port 143. The primary piston 130 and the secondary piston 140 retract to the far end of the cylinder 135. The bolt 138 is accommodated in the bore 133 of primary piston 130. In the position shown in FIG. 4, the insert sleeve 109 and the attached insert segments 118A and 118B can be removed from the insert chamber 107 after first removing the retaining ring 110. Then, new insert segments 118A and 118B having a profile matching the profile of the new workpieces can easily be inserted in the insert chamber 107. After fitting the insert segments 118A and 118B over the flange 121 of the insert actuator 120 so that the annular recess 122 is seated on the flange 121, hydraulic fluid is introduced into cylinder 135 through the fluid port 143, and the primary piston 130 and the secondary piston 140 are repositioned as shown in FIG. 3, and the jaw 100 is ready to receive a workpiece.

A jaw assembly for a stretch former is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A jaw assembly for a stretch former, comprising:

(a) a jaw body;

(b) an annular nose piece carried by said jaw body and defining an insert chamber;

(c) a tapered-wall insert sleeve for being locked into the insert chamber of said nose piece, said insert sleeve defining an internal bore having tapered walls;

(d) an insert for being positioned in the bore of said insert sleeve, said insert having a plurality of segments collectively defining therebetween a profile corresponding to the profile of a workpiece to be stretch-formed, said insert having a tapered outer wall for sliding, interference fit, engagement with the tapered walls of the insert sleeve for locking the insert into the jaw and clamping the workpiece into the insert;

(e) piston means connected to said insert, said piston means adapted to move said insert axially within said nose piece among:

(1) a clamping position wherein said insert clamps the workpiece into the jaw during the stretch forming process;

(2) a workpiece remove position retracted from said clamping position for removing the stretch-formed workpiece from the insert and positioning another workpiece into the insert; and (3) an insert remove position retracted from the workpiece remove position at which the insert sleeve and insert may be removed and replaced;

(f) wherein said piston means comprises:

(i) an insert actuator connected to said insert;

(ii) a piston rod connected to said insert actuator;

(iii) a primary piston carried by said piston rod in a hydraulic cylinder, said primary piston having a stroke defining at a forward extreme thereof the clamping position and at a rearward extreme thereof the insert remove position, and defining a workpiece remove position at a position intermediate the clamping position and the insert remove position; and (iv) a secondary piston coaxially positioned in said cylinder and hydraulically moveable between first and second positions in said cylinder, said secondary piston defining at said first position the intermediate, workpiece remove position of said primary piston and at said rearward extreme position the insert remove position of said primary piston.

2. A jaw assembly according to claim 1, wherein said secondary piston is slidably mounted on a retaining bolt for movement between its first and second positions.

3. A jaw assembly according to claim 1, wherein said cylinder is formed in said jaw body.

4. In a stretch former of the type wherein a workpiece to be formed is clamped and stretched over a die by the action of a tension cylinder, the combination thereof of a jaw assembly carried on a free end of said tension cylinder and clamping an end of said workpiece, said jaw assembly comprising:

(a) a jaw body;

(b) an annular nose piece carried by said jaw body and defining an insert chamber;

(c) a tapered-wall insert sleeve for being locked into the insert chamber of said nose piece, said insert sleeve defining an internal bore having tapered walls;

(d) an insert for being positioned in the bore of said insert sleeve, said insert having a plurality of segments collectively defining therebetween a profile corresponding to the profile of a workpiece to be stretch-formed, said insert having a tapered outer wall for sliding, interference fit, engagement with the tapered walls of the insert sleeve for locking the insert into the jaw and clamping the workpiece into the insert;

(e) piston means connected to said insert, said piston means adapted to move said insert axially within said nose piece among:

(1) a clamping position wherein said insert clamps the workpiece into the jaw during the stretch forming process;

(2) a workpiece remove position retracted from said clamping position for removing the stretch-formed workpiece from the insert and positioning another workpiece into the insert; and (3) an insert remove position retracted from the workpiece remove position at which the insert sleeve and insert may be removed and replaced;

(f) wherein said piston means comprises:

(i) an insert actuator connected to said insert;

(ii) a piston rod connected to said insert actuator;

(iii) a primary piston carried by said piston rod in a hydraulic cylinder, said primary piston having a stroke defining at a forward extreme thereof the clamping position and at a rearward extreme thereof the insert remove position, and defining a workpiece remove position at a position intermediate the clamping position and the insert remove position; and (iv) a secondary piston coaxially positioned in said cylinder and hydraulically moveable between first and second positions in said cylinder, said secondary piston defining at said first position the intermediate, workpiece remove position of said primary piston and at said rearward extreme position the insert remove position of said primary piston.

5. In a stretch former of the type wherein a workpiece to be formed is clamped by its opposing ends and stretched over a die by the action of a pair of opposed tension cylinders, the combination thereof of a jaw assembly carried on a free end of each of said tension cylinders and clamping the opposing ends of said workpiece, each of said jaw assemblies comprising:

(a) a jaw body;

(b) an annular nose piece carried by said jaw body and defining an insert chamber;

(c) a tapered-wall insert sleeve for being locked into the insert chamber of said nose piece, said insert sleeve defining an internal bore having tapered walls;

(d) an insert for being positioned in the bore of said insert sleeve, said insert having a plurality of segments collectively defining therebetween a profile corresponding to the profile of a workpiece to be stretch-formed, said insert having a tapered outer wall for sliding, interference fit, engagement with the tapered walls of the insert sleeve for locking the insert into the jaw and clamping the workpiece into the insert;

(e) piston means connected to said insert, said piston means adapted to move said insert axially within said nose piece among:

(1) a clamping position wherein said insert clamps the workpiece into the jaw during the stretch forming process;

(2) a workpiece remove position retracted from said clamping position for removing the stretch-formed workpiece from the insert and positioning another workpiece into the insert; and (3) an insert remove position retracted from the workpiece remove position at which the insert sleeve and insert may be removed and replaced;

(f) wherein said piston means comprises:

(i) an insert actuator connected to said insert;

(ii) a piston rod connected to said insert actuator;

(iii) a primary piston carried by said piston rod in a hydraulic cylinder, said primary piston having a stroke defining at a forward extreme thereof the clamping position and at a rearward extreme thereof the insert remove position, and defining a workpiece remove position at a position intermediate the clamping position and the insert remove position; and (iv) a secondary piston coaxially positioned in said cylinder and hydraulically moveable between first and second positions in said cylinder, said secondary piston defining at said first position the intermediate, workpiece remove position of said primary piston and at said rearward extreme position the insert remove position of said primary piston.

6. A jaw assembly according to claim 4 or 5, wherein said secondary piston is slidably mounted on a retaining bolt for movement between its first and second positions.

7. A jaw assembly according to claim 4 or 5, wherein said cylinder is formed in said jaw body.

* * * * *